US005161468A

United States Patent [19]

Weeger et al.

[11] Patent Number: 5,161,468

[45] Date of Patent: Nov. 10, 1992

[54] BOGIES FOR RAILED VEHICLES

[75] Inventors: Englebert Weeger, Nuremberg; Lutz Uebel, Heroldsberg; Wolfgang-Dieter Richter, Winkelhaid; Lutz Mauer, Augsburg, all of Fed. Rep. of Germany

[73] Assignee: MAN GHH Schienenverkehrstechnik, Nuremberg, Fed. Rep. of Germany

[21] Appl. No.: 731,542

[22] Filed: Jul. 17, 1991

[30] Foreign Application Priority Data

Jul. 17, 1990 [DE] Fed. Rep. of Germany ... 9010678[U]
Jan. 2, 1991 [EP] European Pat. Off. ..... 91100010.7

[51] Int. Cl.[5] ..... B61F 3/08
[52] U.S. Cl. ..... 105/167
[58] Field of Search ..... 105/165, 167, 168, 218.2, 105/169, 157.1, 171, 182.1

[56] References Cited

U.S. PATENT DOCUMENTS

| | | | |
|---|---|---|---|
| 431,554 | 7/1890 | Butterbaugh | 105/168 |
| 2,296,106 | 9/1942 | Holland et al. | 105/167 |
| 2,360,061 | 10/1944 | Jones | 105/167 |
| 4,003,316 | 1/1977 | Monselle | 105/167 |
| 4,131,069 | 12/1978 | List | 105/168 |
| 4,982,671 | 1/1991 | Chollet et al. | 105/168 |

FOREIGN PATENT DOCUMENTS

| | | | |
|---|---|---|---|
| 3808593 | 9/1989 | Fed. Rep. of Germany . | |
| 3904203 | 8/1990 | Fed. Rep. of Germany | 105/168 |
| 0148655 | 7/1931 | Switzerland | 105/167 |

*Primary Examiner*—Robert J. Oberleitner
*Assistant Examiner*—Mark T. Le
*Attorney, Agent, or Firm*—Morrison Law Firm

[57] ABSTRACT

A bogie for rail vehicles, particularly commuter or short-haul vehicles, has two wheel sets spaced apart in the direction of travel. One wheel set is mounted upon a wheel mounting frame which is coupled to a tranverse member of the bogie frame by way of an intermediate beam member. The arrangement is such that a lateral force applied to one wheel of the set by a curved rail will be translated into a rotational force to rotate the wheel mounting frame and therewith the wheel set, to negate the aforesaid lateral force. Such an arrangement reduces wheel flange wear and the risk of derailment.

12 Claims, 2 Drawing Sheets

BOGIES FOR RAILED VEHICLES

BACKGROUND OF THE INVENTION

This invention relates to bogies for railed vehicles.

Known bogies for railed vehicles, such as commuter or shorthaul rail vehicles or tram cars, have primary springs which operate against bogie frames to allow for relative upward and downward movement of the bogie frames and the bogie wheels. Secondary springs are provided between a bogie frame and a car or vehicle body to provide a secondary spring action. In such bogies, it is also conventional to provide wheels in sets with the sets spaced longitudinally of the bogie and the wheels of each set spaced laterally of the bogie. One set of wheels are normally provided as idle or nondriven wheels which are rigidly connected to a wheel mounting frame, for example by pedestal bearings, with the wheel mounting frame extending transversely of the bogie frame and coupling by bearing arrangements to a transversely extending frame member of the bogie frame. The bogie and wheel mounting frames are relatively immovable longitudinally of the bogie except for vertical pivoting movements of the mounting frame upon the bogie frame allowed for by the bearing arrangements. The latter also permit lateral movement of the mounting frame between limits, such lateral movement, for instance, being caused by an axial load placed against a flange of a wheel by a rail when the bogie is travelling along rails.

Such a bogie is described in U.S. Pat. No. 4,941,409 issued Jul. 17, 1990, to which the reader is directed for reference, which is incorporated herein by reference, and in its German equivalent, Offenlegungschrift number 3,808,593. The bogie structure described therein is suitable for use when a vehicle or car is for travelling around rail curvatures of large radius, but when travelling around small radius curvatures, the movement available to the wheel mounting frame may not enable its wheels to accommodate the curvature of the rails without undue resistance. As a result, undue pressure is applied either to one wheel flange or the other during travel around curvatures of small radius. This pressure, assisted by the slippage between the rail and the radial surface of the wheel flange, results in inordinate wear of the engaging surfaces. This undesirable result is found even though negligible wear between rails and wheel flanges results when the bogie travels in a straight line.

The present invention seeks to provide a bogie which is capable of being used on rails having path curvatures of any acceptable radius while mitigating the above problem.

Accordingly, the present invention provides a bogie comprising:

a bogie frame extending in a longitudinal direction of the bogie;

at least two bogie wheel sets spaced longitudinally of the bogie with the wheels of each set spaced apart laterally of the bogie;

a wheel mounting frame extending transversely of the bogie frame and rotatably carrying the wheels of one of the wheel sets; and a coupling arrangement coupling the wheel mounting frame to the bogie frame, the coupling arrangement permitting pivoting of the wheel mounting frame about a vertical pivot axis and permitting limited lateral movement of the wheel mounting frame relative to the bogie frame, the coupling arrangement being configured to translate lateral forces exerted upon one or other of the wheels carried by the wheel mounting frame to provide a component of force acting to rotate the wheel mounting frame relative to the bogie frame and turn the wheel set mounted thereupon so as to reduce said lateral force.

The wheel mounting frame may be coupled to the bogie frame by way of an intermediate member suspended from a cross member of the bogie frame. The coupling arrangement may then comprise pivot means coupling the intermediate member to the bogie frame and coupling mechanisms coupling the intermediate member to the wheel mounting frame.

In a particularly practical and desirable arrangement, both the intermediate member and the wheel mounting frame are disposed at positions lower than the height of the bogie frame at positions between the sets of wheels. This desirable arrangement allows the car or vehicle body to be disposed at a particularly low level, with floor height of as little as 30 cms. being possible.

The pivot means may comprise two resilient connection arrangements which are spaced-apart longitudinally of the bogie to provide a pivot axis, for the wheel mounting frame, at a position between the connection arrangements. With the connection arrangements disposed in tandem along the longitudinal axis of the bogie frame, a pivoting movement of the wheel mounting frame and accompanying set of wheels is possible up to an angle of approximately 1.5 to 3. The resilient connection arrangements preferably each comprise a rigid spindle with an upwardly extending (e.g. substantially vertical) major axis, a resiliently deformable surround, for example of elastomeric material, bonded to the spindle, and an outer rigid sleeve member bonded to the surround. Such a structure advantageously allows the rigid sleeve member and the spindle to tilt relative to each other in any direction, i.e. universally.

The coupling mechanisms may each comprise a cylindrical metal arbour, surrounded by an elastomeric layer which is encased by a metal sleeve which is a press fit in a housing element, specifically a journal boss, of the intermediate member. The metal arbour may then have reduced diameter bearing journals positively located in supports mounted to the intermediate member.

The two coupling mechanisms connecting the wheel mounting frame to the intermediate member may be disposed one on each side of a longitudinal axis of the bogie. Interengaging parts of each coupling mechanism may slide relative to each other along an axis which is inclined at an angle, preferably 10 to 40, to the longitudinal axis of the bogie. With this latter arrangement, and with the directions of action being at opposite angles to the longitudinal axis, any lateral movement of the wheel mounting frame is accompanied by a slight pivoting movement of the wheel mounting frame. The force applied to the one wheel by a curved rail will be transmitted to the inclined coupling mechanisms and result in a component of force acting to pivot the wheel mounting frame so as to tend to reduce the load upon the wheel flanges, thereby reducing wear. The pivoting movement of the wheel mounting frame upon the two coupling mechanisms is accommodated by the coupling mechanisms until the limit of the elastic play between the metal sleeves and supports is reached, whereupon the lateral load is transmitted through the intermediate frame to the central pivot between the intermediate frame and the bogie frame member.

A compound movement of the wheel mounting frame is thus made possible, with the pivoting movement of the wheel mounting frame taking place about a pivotal point in the middle between the centring bearings. The elastic coupling between the wheel mounting frame and the intermediate beam on the one hand and the intermediate beam and the bogie transverse beam on the other hand cause a superimposed movement in opposite directions, through which automatic radial adjustment of the wheel pairs is achieved.

It has been found that a suitable compound movement can be achieved with the relationships between the various factors adjusted as follows:

the resiliently deformable sleeve has a Shore hardness of from 50 to 80;

the resiliently deformable surround has a Shore hardness of from 40 to 70;

the angle of inclination between the longitudinal axis of the bogie and the direction of action of each coupling mechanism is from 10 to 40 with the directions of action oppositely inclined;

the distance between the coupling mechanisms is between 300 and 800 mm; and the distance between axes of the resilient connection arrangements of the central pivot is between 100 and 250 mm.

The above and other objects and advantages of the present invention will become apparent from the following description read in conjunction with the accompanying drawings, in which like reference numerals designate the same element.

DETAILED DESCRIPTION

Figure 1:
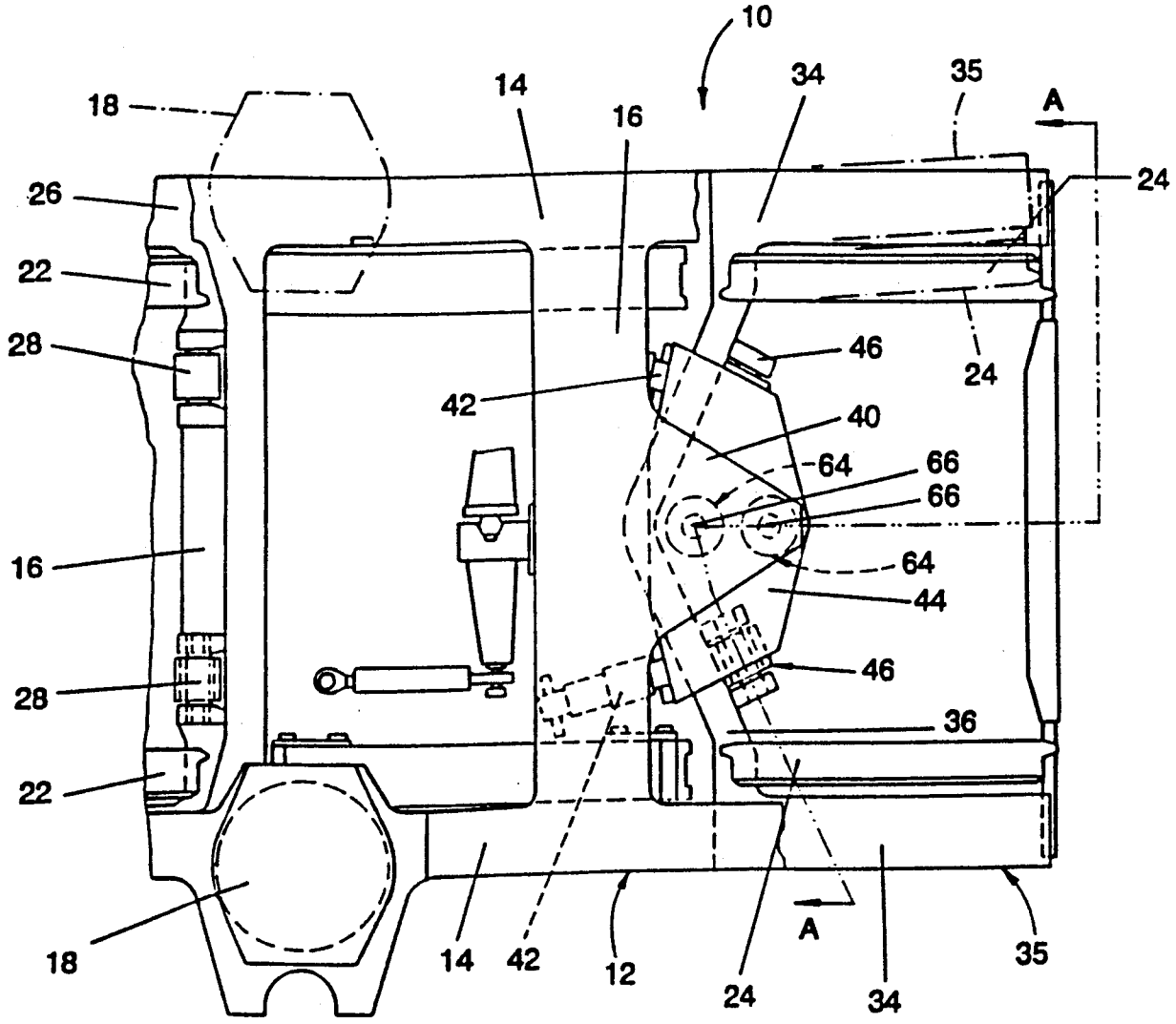
FIG. 1 is a plan view of part of a bogie and showing the bogie in a first position in full outline and in a second position in chaindotted outline.
Figure 2:
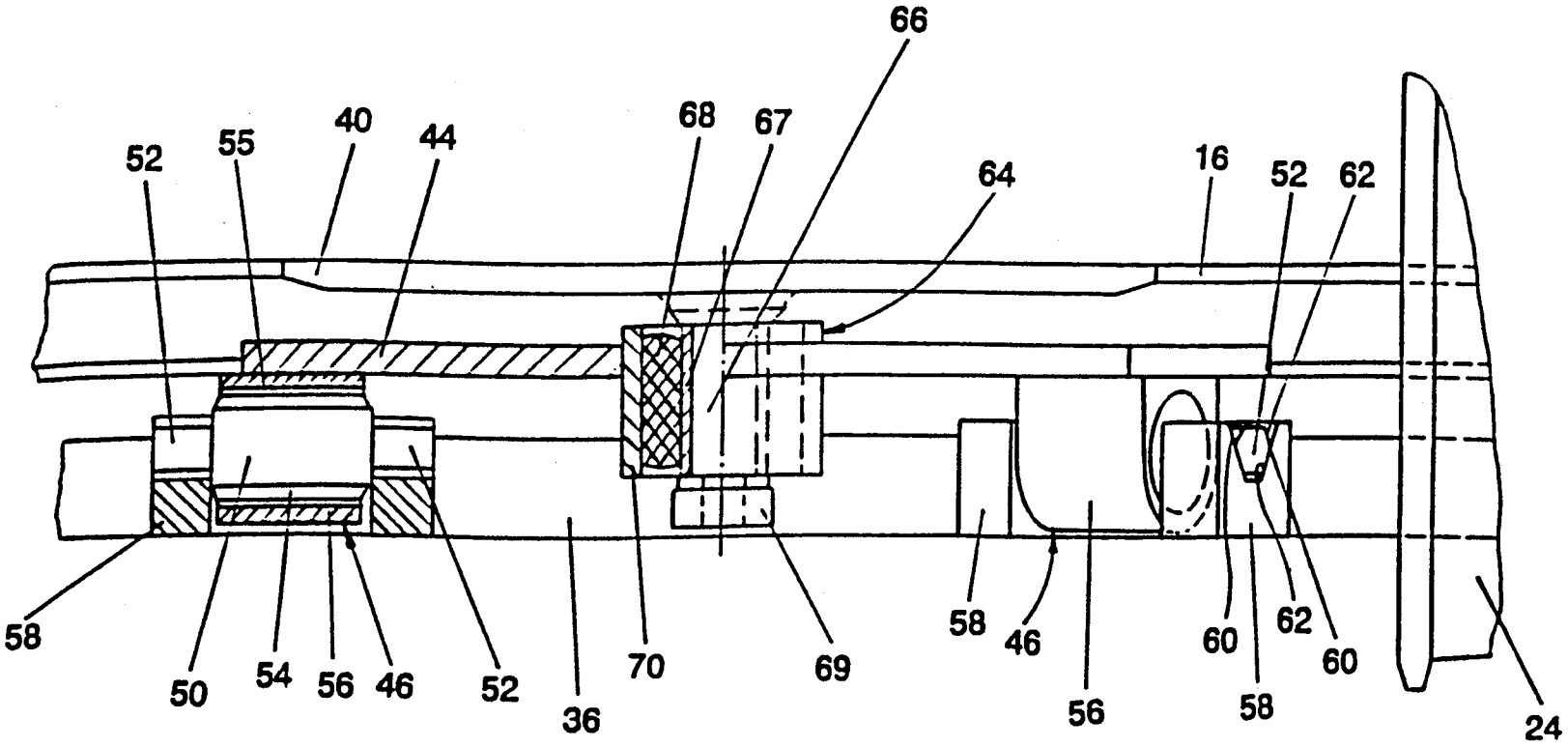
FIG. 2 is a horizontal sectional view of the bogie taken along line A—A in FIG. 1.

As shown by FIGS. 1 and 2, a bogie 10 comprises a rigid bogie frame 12 having two laterally spaced longitudinally extending side members 14 joined together by transversely extending frame members 16. Two springs 18 (referred to as "secondary" springs) are supported by, and extend upwardly from, the side members 14 for resiliently supporting a car or vehicle body (not shown).

The bogie comprises two sets of wheels, a set of driven wheels 22 at one end of the bogie and a set of idle or non-driven wheels 24 at the other end. The driven wheels 22 are rotatably mounted independently of one another and laterally spaced in axial alignment upon a frame 26 which is pivoted at one end by two axially spaced bearings 28 (FIG. 1). The frame 26 has two primary springs (not shown) acting between the frame 26 and overhead parts of the bogie frame with which the primary springs are vertically aligned.

The idle or non-driven wheels 24 are independently rotatably mounted by pedestal bearings (not shown) upon two arms 34 of a wheel mounting frame 35 which has a frame member 36 of chevron shape in plan view. The frame member 36 extends transversely of the bogie frame to interconnect one end of one arm 34 to an end of the other arm 34.

The wheel mounting frame 35 extends with its frame member 36 extending horizontally and lower than the frame member 16, which has a longitudinally extending projection 40 symmetrically positioned relative to a longitudinal axis of the bogie and overlying part of frame member 36. Two dampers 42, one on each side of the longitudinal axis of the bogie, are provided to dampen shock loads from the frame member 36 to the frame member 16. Between the frame members 36 and 16 is disposed a plate-like intermediate beam member 44.

The wheel mounting frame 34 is suspended from the intermediate frame member 44 by two resilient coupling mechanisms 46, disposed on respective arms of the chevron-shaped frame member 36. These two coupling mechanisms are positioned at equal distances apart, one on each side of the longitudinal axis of the bogie, so that they are spaced laterally of the bogie frame. As is more clearly shown by FIG. 2, each resilient coupling mechanism comprises a rigid shaft element or arbour having a large diameter axially extending centre section 50 and two axially aligned journal ends 52 of smaller cross-section. Surrounding and bonded to the centre section 50 is a resiliently deformable sleeve 54 of elastomeric material. Surrounding the deformable sleeve 54 is a metal sleeve 55. The metal sleeve 55 is disposed within and bonded to a rigid housing element 56. The housing element 56 depends from the underside of the intermediate member 44. The journal ends 52 of the shaft element 48 are non-rotatably received by support brackets 58 attached to a side surface of the frame member 36. Each bracket 58 has an upwardly open wedge-shaped recess. Each end 52 of each shaft 48 is hexagonal in cross-section with two of its six surface portions 62 intimately engaged with the surfaces 60 of the recess as shown by FIG. 2.

In a stable first condition of each resilient coupling mechanism 46, its metal sleeve 55 is spaced axially from each support bracket 58 (FIG. 2), but is slidable along the major axis of the coupling mechanism which extends generally laterally of the bogie. Thus an axial force of sufficient strength applied to a wheel 24 will cause lateral movement of the wheel mounting frame 35 relative to the bogie frame. This movement is permitted by resilient axial shear movement of the sleeves 54 until the metal sleeve 55 abuts the support bracket 58. The resiliently deformable sleeves 54 have a Shore hardness preferably between 50 to 80.

As shown by FIG. 1, the axial direction of each coupling mechanism 46, and thus its direction of resilient action is inclined to the transverse axis of the bogie at an angle of from 10 to 40. Thus, initial lateral movement of the wheel mounting frame 35 is accompanied by a slight pivoting movement of the wheel mounting frame, afforded by the elastomeric sleeve 54.

The pivotal connection between the intermediate member 44 and the projection 40 of frame member 16 comprises pivot means in the form of two resilient centering bearings 64 which lie in tandem along the longitudinal axis of the bogie. Each bearing 64 comprises a rigid spindle 66 secured to, and extending substantially vertically downwardly from, the projection 40. Around the spindle 66 is a metal sleeve 67 held in position by a retaining nut 69. Surrounding and bonded to the metal sleeve 67 is a resiliently deformable surround 68 of elastomeric material. Surrounding and bonded to the surround 68 is an outer rigid cylindrical member 70. The member 70 extends through and is secured to the intermediate member 44. The surround 68 is made from a material preferably with a Shore hardness of from 40 to 70 and with its thickness correctly chosen in relation to the Shore hardness of the resiliently deformable sleeves 54 and to other dimensions of the bogie, such as the distance between the connection arrangements 64 and between the resilient coupling mechanisms 46. The surround 68 is capable of allowing for pivotal movement of the rigid cylindrical member 70 axially around the spindle 66 and also allows for tilting of the member 70 in any plane, i.e. universally, relative to the spindle 66. Hence, the intermediate frame 44 is tiltable in any plane about the pivot bearings 64. The pivoting action of the intermediate frame 44 around the two bearings 64 may be complex. Any pivoting action, either horizontally around the axes of the spindles 66 or in any vertical plane, actually occurs about a resultant axis lying between the two bearings 64 as both of the surrounds 68 are deformed simultaneously and to a required degree.

In use, lateral movement of the wheel mounting frame 35 takes place in the appropriate direction if a flange of a wheel 24 has a lateral load placed against it by the outside rail as the bogie moves around a curve. Initially the lateral load will displace wheel mounting frame 35 relative to the intermediate member 44 until the sleeve 55 of the coupling mechanism abuts the adjacent support bracket 58. When this occurs, the lateral load is transmitted to the pivot assembly 64, 66. The centring bearings 64, 66 are both elastically deformable and so the intermediate member 44 pivots about an axis between them. As a result, the wheel mounting frame moves laterally while being pivoted to a small degree, steering the wheel pair 24 as illustrated by chain dot lines in FIG. 1. This movement, results in reducing the load upon the wheel flanges, and turns the wheels 22.

Embodiments of the invention thus allow automatic radial adjustment of the wheel pair, enabling a bogie to negotiate rails having small or large radius of curvature while minimising wear upon wheel flanges and reducing the risk of derailment.

Having described preferred embodiments of the invention with reference to the accompanying drawings, it is to be understood that the invention is not limited to the precise embodiments and that various changes and modifications may be affected therein by one skilled in the art without departing from the scope or spirit of the invention which is limited only by the appended claims.

What is claimed is:

1. A bogie comprising:

a bogie frame extending in a longitudinal direction of the bogie;

at least two bogie wheel sets spaced longitudinally of the bogie with the wheels of each set spaced apart laterally of the bogie;

a wheel mounting frame extending transversely of the bogie frame and rotatably carrying the wheels of one of the wheel sets;

an intermediate member; and a coupling arrangement coupling the wheel mounting frame to the bogie frame;

said coupling arrangement permitting pivoting of the wheel mounting frame about a vertical pivot axis;

said coupling arrangement including means for permitting limited lateral movement of the wheel mounting frame relative to the bogie frame;

said coupling arrangement being positioned so as to translate lateral force exerted upon one or the other of the wheels carried by the wheel mounting frame to provide a component of force acting to rotate the wheel mounting frame relative to the bogie and turn the wheel set mounted thereupon;

said coupling arrangement comprising resilient pivot means coupling said intermediate member to said bogie frame and two resilient coupling mechanisms coupling said wheel mounting frame to said intermediate member, said coupling mechanisms being spaced apart laterally of the bogie frame.

2. A bogie according to claim 1, wherein the bogie frame has at least one transverse frame member and said resilient pivot means couples said intermediate member to said transverse frame member.

3. A bogie according to claim 1, wherein said two resilient coupling mechanisms are disposed with their respective major axes inclined towards substantially the same position of the longitudinal axis of the bogie and with opposite angles of inclination.

4. A bogie according to claim 3, wherein each of said major axes is inclined at an angle between 10 and 40 to the longitudinal axis.

5. A bogie according to claim 1, wherein each said coupling mechanism comprises support members secured to one of the wheel mounting frame and the intermediate member, a housing element secured to the other of the wheel mounting frame and the intermediate member, and a rigid shaft element mounted in said support members, a resiliently deformable sleeve surrounding said rigid shaft element and surrounded by said housing element, each coupling mechanism having a major axis directed laterally of the bogie with the sleeve being deformable to allow for limited relative axial movement of the shaft and housing elements to permit lateral movement of the wheel mounting frame.

6. A bogie according to claim 5, wherein in each coupling mechanism the rigid shaft element has ends projecting beyond the deformable sleeve and beyond the housing element, said ends being non-rotatably received by end-engaging surfaces of said support members.

7. A bogie according to claim 5, wherein each said support member has a surface inclined relative to the lateral axis of said bogie, each rigid housing element extends between the corresponding support brackets and, when not subjected to lateral forces, is spaced axially from each support bracket, the housing element contacting a said inclined surface at a limit of said relative axial movement of the rigid shaft and housing elements.

8. A bogie according to claim 1, wherein said pivot means comprises two bearing members disposed in tandem in the direction of travel of the bogie and providing a pivot axis between the respective axes of the two bearing members.

9. A bogie according to claim 1, wherein the pivot means comprises at least one resilient connection arrangement having a rigid spindle with an upwardly extending major axis, a resiliently deformable surround surrounding and bonded to said spindle, and an outer rigid member bonded around the resiliently deformable surround, the spindle secured to one of the intermediate member and bogie frame and the outer rigid member secured to the other of the intermediate member and bogie frame, and the resiliently deformable surround resiliently allowing relative pivotal and universally tiltable movement of the rigid spindle and outer rigid member.

10. A bogie according to claim 1, wherein said intermediate frame member and said wheel mounting frame lie at positions lower than the bogie frame.

11. A bogie comprising:

a wheel mounting frame on said bogie:

at least one set of wheels consisting of a first and second wheel spaced laterally on said wheel mounting frame;

means for permitting the wheel mounting frame to pivot about a vertical axis in response to a lateral force on one of said first and second wheels;

means for restoring said wheel mounting frame to an equilibrium position in the absence of said lateral force; and said means for permitting the mounting frame to pivot is a coupling arrangement comprising a resilient pivot means coupling an intermediate member to the bogie frame and two resilient coupling mechanisms coupling said wheel mounting frame to the intermediate member, said coupling mechanisms being spaced laterally of the bogie frame.

12. A bogie comprising:

a bogie frame extending in a longitudinal direction of the bogie;

at least two bogie wheel sets spaced longitudinally of the bogie with the wheels of each set spaced apart laterally of the bogie;

a wheel mounting frame extending transversely of the bogie frame and rotatably carrying the wheels of one of the wheel sets;

a plate-like intermediate beam member; and a coupling arrangement coupling the wheel mounting frame to the bogie frame;

said coupling arrangement permitting pivoting of the wheel mounting frame about a vertical pivot axis;

said coupling arrangement including means for permitting limited lateral movement of the wheel mounting frame relative to the bogie frame;

said coupling arrangement being positioned so as to translate lateral force exerted upon one or the other of the wheels carried by the wheel mounting frame to provide a component of force acting to rotate the wheel mounting frame relative to the bogie and turn the wheel set mounted thereupon;

said coupling arrangement comprising:

a rigid shaft element, connected to the bogie frame, having an axially extending center section between two axially aligned journal ends;

a metal sleeve surrounding said center section of said shaft element;

a resiliently deformable sleeve of elastomeric material surrounding and bonded to said metal sleeve;

a rigid housing element, connected to said plate-like intermediate beam member, surrounding said deformable sleeve; and coupling mechanisms coupling said wheel mounting frame to said plate-like intermediate beam member.

* * * * *